US005679038A

United States Patent [19]

Neisen et al.

[11] Patent Number: 5,679,038

[45] Date of Patent: Oct. 21, 1997

[54] PULSATING FLUSHING DEVICE

[75] Inventors: Gerald F. Neisen, Oshkosh; Richard A. Davis, Mequon; James C. Hubbell, Fond du Lac, all of Wis.

[73] Assignee: Brunswick Corporation, Lake Forest, Ill.

[21] Appl. No.: 658,886

[22] Filed: May 30, 1996

[51] Int. Cl.[6] ..... B63H 21/10

[52] U.S. Cl. ..... 440/88; 137/565.1; 134/169 R; 440/900

[58] Field of Search ..... 440/88, 900; 137/262, 137/565.1, 624.13; 134/166 R, 169 R

[56] References Cited

U.S. PATENT DOCUMENTS 2,644,474 7/1953 Houchin ..... 134/166 R 4,549,567 10/1985 Horton ..... 137/262

5,350,329 9/1994 Haman ..... 440/88

5,482,483 1/1996 Rice ..... 440/88

*Primary Examiner*—Edwin L. Swinehart

*Attorney, Agent, or Firm*—Andrus, Sceales, Starke & Sawall

[57] ABSTRACT

A flushing device (30) for the cooling system of a marine drive (10) includes a housing (32) having an inlet (34) for receiving pressurized flushing coolant, an outlet (36) for discharging the flushing coolant to the marine drive cooling system, a pulsation chamber (33) between the inlet (34) and outlet (36), and a pulsation mechanism (40) in the pulsation chamber (38) and receiving the pressurized flushing coolant and imparting a pulsation movement thereto and delivering pulsating flushing coolant to the outlet (36).

15 Claims, 3 Drawing Sheets

30
32
34
36
38
40
42
44
46
48
50
52
54
56
58
60
62
64
66
68
70
72
74
76
78
80
82
84
85
86
92
94
96
98
100
104
106
108
110
118
120

PULSATING FLUSHING DEVICE

BACKGROUND AND SUMMARY

The invention relates to flushing devices for cooling systems of marine drives.

In marine drives, particularly in salt water environments, it is desirable to periodically flush the cooling system, to prevent corrosion. The flushing device of the present invention provides pulsating flushing of he marine drive cooling system.

DETAILED DESCRIPTION

Figure 1:
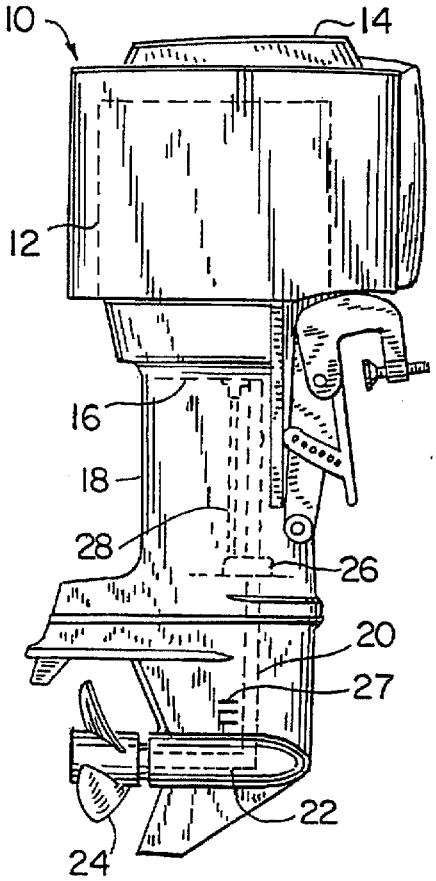
FIG. 1 is a side view of a marine drive.

FIG. 1 shows a marine drive in the form of an outboard marine propulsion unit 10 having a powerhead 12 including an internal combustion engine and covered by cowl 14. The powerhead is mounted on an adaptor plate 16 at the top of a lower gearcase 18 having a vertical driveshaft 20 driven by the powerhead and driving a lower horizontal propeller shaft 22 having a propeller 24 mounted thereto. The gearcase has apertures 27 in the sides thereof delivering cooling sea water to a water pump 26 which is driven by vertical driveshaft 20 extending therethrough, for example U.S. Pat. Nos. 4,392,779 and 4,820,214, incorporated herein by reference. Water tube 28 extends upwardly from water pump 26 to adaptor plate 16 for delivering cooling sea water through a passage in the latter to the powerhead, all as is known.

Figures 2, 3, 4:
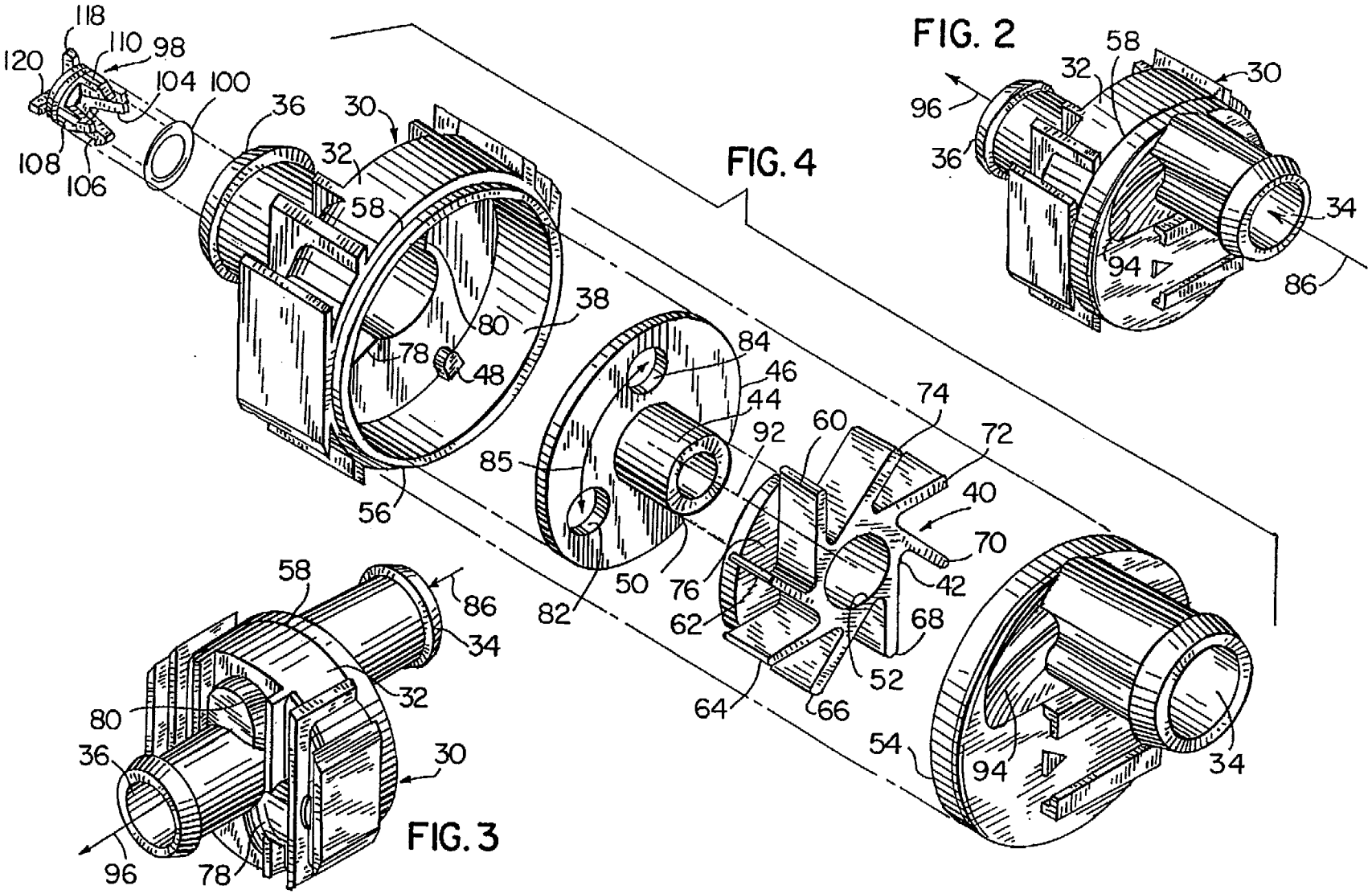
FIG. 2 is an isometric view from the input side of a flushing device in accordance with the present invention.
FIG. 3 is an isometric view of the flushing device of FIG. 2 from the output side.
FIG. 4 is an exploded isometric view of the flushing device of FIG. 2.

The present invention provides a flushing device 30, FIGS. 2–4, for providing pulsating flushing of the cooling system of the marine drive. Flushing device 30 includes a housing 32 having an inlet 34 for receiving pressurized flushing coolant, for example from a garden hose or the like on a boat dock, and an outlet 36 for discharging the flushing coolant to the cooling system of the marine drive, preferably at a point downstream of pump 26. Housing 32 includes a pulsation chamber 38 between inlet 34 and outlet 36. A pulsation mechanism 40 in pulsation chamber 38 receives the pressurized flushing coolant and imparts a pulsating movement thereto and delivers pulsating flushing coolant to outlet 36.

Figure 6:
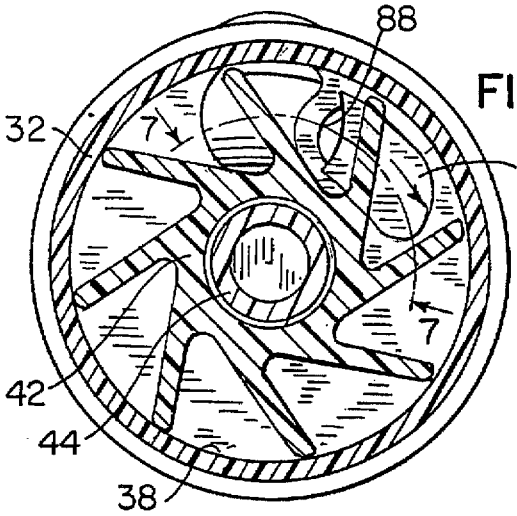
FIG. 6 is a sectional view taken along line 6—6 of FIG. 5.
Figure 9:
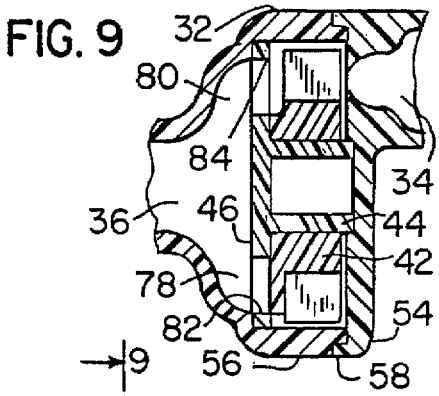
FIG. 9 is a sectional view taken along line 9—9 of FIG. 8.
Figure 8:
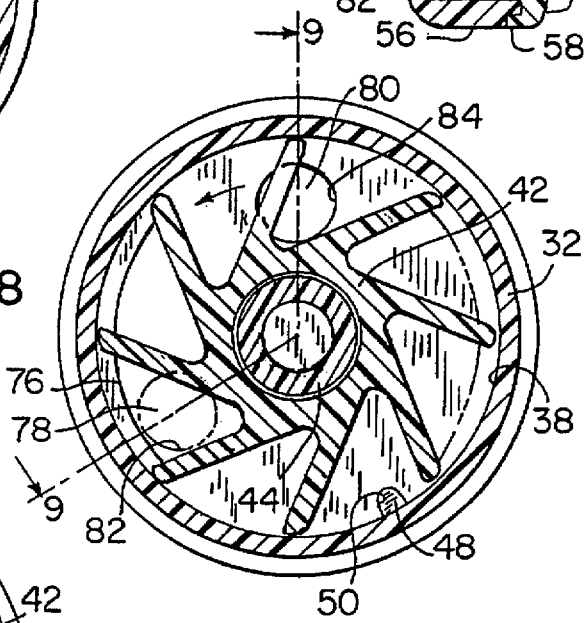
FIG. 8 is a sectional view taken along line 8—8 of FIG. 5.
Figure 10:
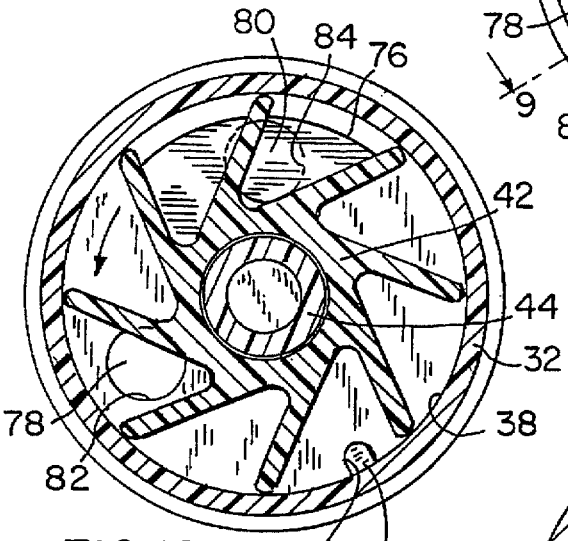
FIG. 10 is a view like FIG. 8 but showing a different rotated position of the turbine wheel.

The pulsation device 40 is provided by a turbine wheel 42 driven by the pressurized flushing coolant from inlet 34 to rotate, counterclockwise as viewed in FIGS. 6, 8, 10, in pulsation chamber 38 and deliver flushing coolant in pulsed bursts to outlet 36. Turbine wheel 42 rotates on spindle 44 extending from plate 46 which rests in housing 32 and is prevented from rotating by key 48 of the housing extending into notch 50 of the plate. Spindle 44 extends into central aperture 52 of turbine wheel 42, and the turbine wheel freely rotates thereon. The inlet side 54 of the housing is mated to the outlet side 56 of the housing along perimeter flange or lip 58 and held thereto in assembled condition by adhesive bonding, sonic welding or the like.

Turbine wheel 42 has a plurality of vanes 60, 62, 64, 66, 68, 70, 72, 74, and a flange 76 extending between at least two of such vanes, preferably three, as shown at flange 76 spanning and extending between vanes 60 and 64. Pulsation chamber 38 has at least one and preferably two discharge ports 78 and 80 each communicating with outlet 36. Discharge ports 78 and 80 are aligned with respective apertures 82 and 84 in plate 46 and receive flushing coolant therethrough for discharge to outlet 36. During rotation of turbine wheel 42, vanes 60–74 move past the discharge ports to discharge coolant from between respective vanes to the respective discharge port.

During one portion of each rotational cycle of the turbine wheel, flange 76 moves past and covers aperture 82 and discharge port 78 to substantially block and temporarily interrupt discharge of coolant flow through discharge port 78. Aperture 84 and discharge port 80 remain open during this portion of the rotational cycle as shown in FIG. 8, to provide an exit path for coolant in pulsation chamber 38 when flange 76 is covering aperture 82 and discharge port 78, to facilitate continued rotation of turbine wheel 42. This provides a hydraulic lock relief, to prevent hydraulic lock.

Figure 11:
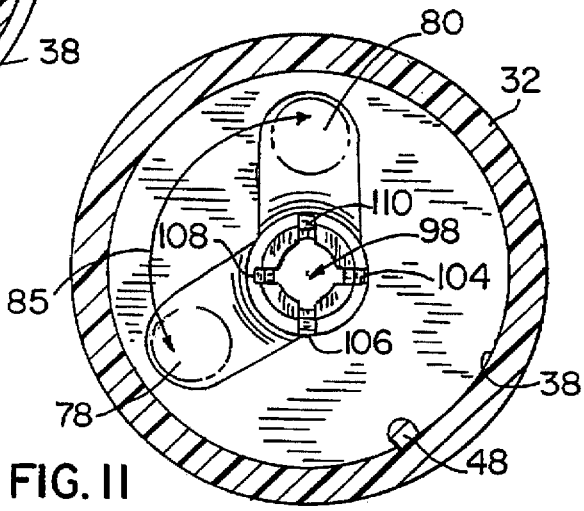
FIG. 11 is a sectional view taken along line 11—11 of FIG. 5.

During another portion of the rotational cycle of turbine wheel 42, as shown in FIG. 10, aperture 84 and discharge port 80 are covered and blocked by flange 76 to substantially block discharge of coolant through discharge port 80 to interrupt the flow of coolant through such discharge port. During this portion of the cycle, aperture 82 and discharge port 78 are open and uncovered by flange 76, to thus provide an exit path for coolant in pulsation chamber 38, to facilitate continued rotation of turbine wheel 42, and provide a relief preventing hydraulic lock. At least one of the discharge ports 78 and 80 is always open and uncovered by flange 76 at any point in the rotational cycle of turbine wheel 42, such that coolant may exit pulsation chamber 38 at all times during the rotational cycle, to prevent hydraulic lock. Aperture 82 and discharge port 78 are spaced from aperture 84 and discharge port 80 along an arc of rotation of turbine wheel 42 by an arcuate distance 85, FIGS. 4 and 11, greater than the arcuate span of flange 76 such that the discharge ports are never simultaneously covered and blocked by flange 76.

Figure 7:
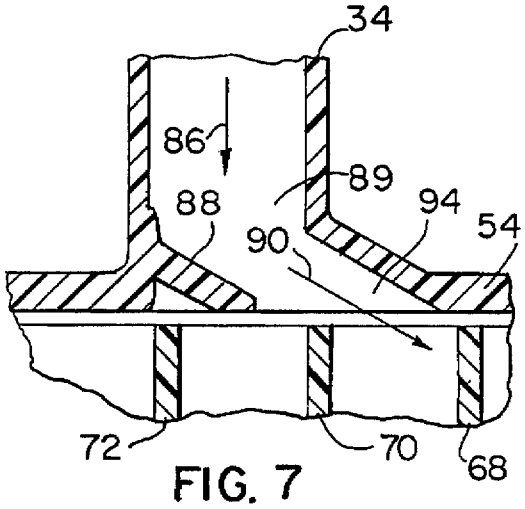
FIG. 7 is a sectional view taken along line 7—7 of FIG. 6.

Inlet 34 extends into pulsation chamber 38 along a first direction 86, FIG. 2, and includes a diverter 88, FIG. 7, diverting flushing coolant along a second direction 90 to engage the turbine vanes and drivingly rotate the turbine wheel. Inlet 34 is constricted at 89 which in combination with diverter 88 provides an acceleration ramp directing and accelerating flushing coolant along direction 90 having an arcuate component and impinging the turbine wheel vanes. Direction 86 is parallel to the axis of rotation 92, FIG. 4, of turbine wheel 42 and is offset therefrom. Inlet 34 along direction 86 is coaxial with aperture 84 and discharge port 80, and diverter 88 diverts flushing coolant into pulsation chamber 38 at a point 94 offset from aperture 84 and discharge port 80. Outlet 36 extends along direction 96 coaxial with axis 92 and parallel to direction 86 and offset therefrom and offset from discharge ports 78 and 80.

Figure 5:
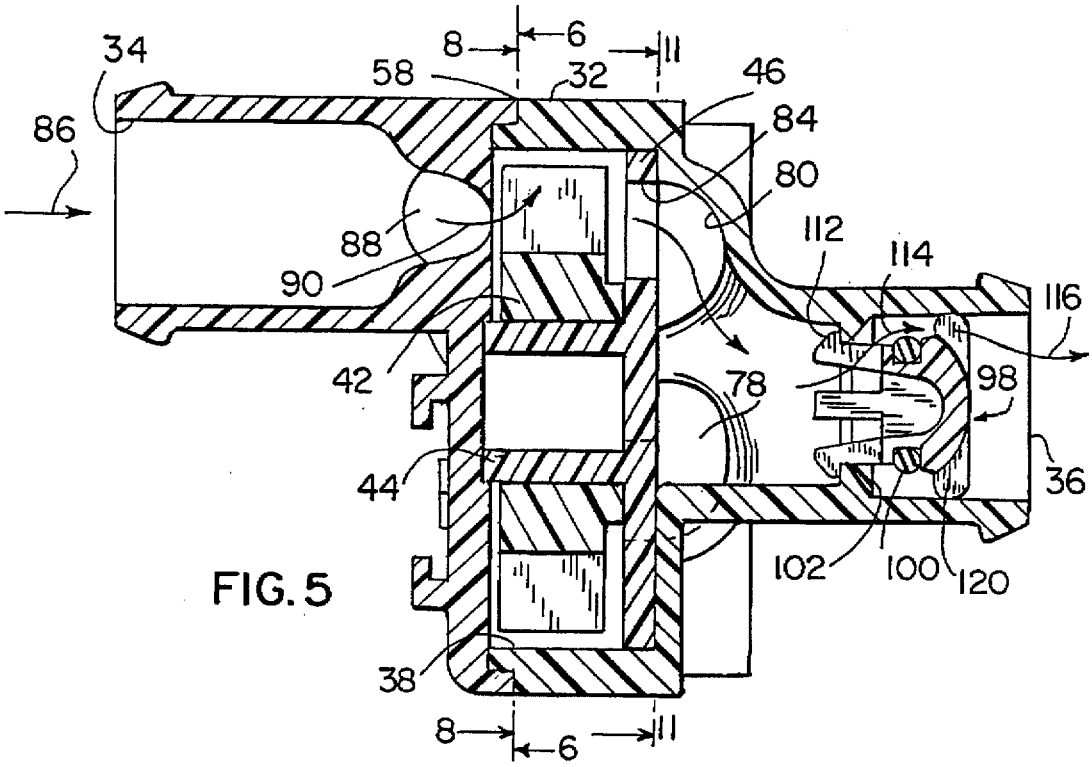
FIG. 5 is a sectional view of the flushing device of FIG. 2.

Outlet 36 includes a one-way valve 98 permitting flow out of the flushing device but blocking reverse flow back into the flushing device from the marine drive cooling system. The one-way valve includes an O-ring 100, FIG. 5, for seating against shoulder 102 in sealing relation to block leftward flow as viewed in FIG. 5, and a plurality of legs 104, 106, 108, 110, FIG. 4, having inner ends with radially outwardly extending fingers such as 112, FIG. 5, engaging the opposite side of shoulder 102 in an open valve condition and permitting coolant to flow as shown at arrows 114, 116 between legs 104, 106, 108, 110 and around O-ring 100 spaced rightwardly from shoulder 102 and then further rightwardly as shown at 116 between the outer legs such as 118, 120, FIG. 4.

It is recognized that various equivalents, alternatives and modifications are possible within the scope of the appended claims.

We claim:

1. A flushing device for providing pulsating flushing of a marine drive cooling system, comprising a housing having an inlet for receiving pressurized flushing coolant, an outlet for discharging said flushing coolant to said cooling system, and a pulsation chamber between said inlet and said outlet, a pulsation mechanism in said pulsation chamber and receiving said pressurized flushing coolant and imparting a pulsating movement thereto and delivering pulsating flushing coolant to said outlet.

2. The invention according to claim 1 wherein said pulsation mechanism comprises a turbine wheel driven by said pressurized flushing coolant from said inlet to rotate in said pulsation chamber and deliver said flushing coolant in pulsed bursts to said outlet.

3. The invention according to claim 2 wherein said turbine wheel comprises a plurality of vanes and a flange extending between at least first and second of said vanes, said pulsation chamber includes a discharge port communicating with said outlet, wherein during rotation of said turbine wheel, said vanes move past said discharge port to discharge coolant from between respective vanes to said discharge port, and wherein during a portion of each rotational cycle of said turbine wheel, said flange moves past and covers said discharge port to substantially block discharge of coolant to interrupt the flow of coolant through said discharge port.

4. The invention according to claim 3 comprising a hydraulic lock relief providing an exit path for coolant in said pulsation chamber when said flange is covering said discharge port to facilitate continued rotation of said turbine wheel.

5. The invention according to claim 4 wherein said hydraulic lock relief comprises a second discharge port in said chamber and covered and blocked by said flange during a second portion of said rotational cycle of said turbine wheel.

6. The invention according to claim 5 wherein during said first mentioned portion of said rotational cycle, said second discharge port is open, and during said second portion of said rotational cycle, said first mentioned discharge port is open.

7. The invention according to claim 6 wherein said second discharge port is in communication with said outlet, and at least one of said first and second discharge ports is always open and uncovered by said flange at any point in said rotational cycle, such that coolant may exit said pulsation chamber at all times during said rotational cycle, to prevent hydraulic lock.

8. The invention according to claim 2 wherein said inlet extends into said pulsation chamber along a first direction and includes a diverter diverting flushing coolant along a second direction to engage and drivingly rotate said turbine wheel.

9. The invention according to claim 8 wherein said first direction is parallel to the axis of rotation of said turbine wheel and offset therefrom.

10. The invention according to claim 9 wherein said pulsation chamber includes a discharge port communication with said outlet, and said first direction is coaxial with said discharge port, and said diverter diverts flushing coolant into said pulsation chamber at a point offset from said discharge port.

11. The invention according to claim 10 wherein said outlet extends along a second direction parallel to said first direction and offset therefrom and offset from said discharge port.

12. The invention according to claim 1 comprising in combination a one-way valve in said outlet permitting coolant flow from said pulsation chamber out through said outlet and preventing coolant flow in the reverse direction back into said outlet.

13. A flushing device for providing pulsating flushing of a marine drive cooling system, comprising a housing having an intake port for receiving pressurized flushing coolant, first and second discharge ports for discharging said flushing coolant to said cooling system, and a pulsation chamber between said intake port and said discharge ports, a pulsation mechanism in said pulsation chamber and receiving said pressurized flushing coolant and imparting a pulsating movement thereto and delivering pulsating flushing coolant to said first and second discharge ports.

14. The invention according to claim 13 wherein said pulsation mechanism comprises a turbine wheel driven by said pressurized flushing coolant from said intake port to rotate in said pulsation chamber and deliver said flushing coolant in pulsed bursts to said first and second discharge ports, said turbine wheel comprising a plurality of vanes and a flange extending between at least first and second of said vanes, wherein during rotation of said turbine wheel, said vanes move past said discharge ports to discharge coolant from between respective vanes to said discharge ports, and wherein during a first portion of each rotational cycle of said turbine wheel, said flange moves past and covers said first discharge port to substantially block discharge of coolant to interrupt the flow of coolant through said first discharge port, and wherein during a second portion of each rotational cycle of said turbine wheel, said flange moves past and covers said second discharge port to substantially block discharge of coolant to interrupt the flow of coolant through said second discharge port, and wherein said first and second discharge ports are spaced from each other along an arc of rotation of said turbine wheel by an arcuate distance greater than the arcuate span of said flange such that said first and second discharge ports are never simultaneously covered and blocked by said flange.

15. A flushing device for providing pulsating flushing of a marine drive cooling system, comprising a housing having an inlet for receiving pressurized flushing coolant, an outlet for discharging said flushing coolant to said cooling system, and a pulsation chamber between said inlet and said outlet, a pulsation mechanism in said pulsation chamber and receiving said pressurized flushing coolant and imparting a pulsating movement thereto and delivering pulsating flushing coolant to said outlet, said pulsation mechanism comprising a turbine wheel driven by said pressurized flushing coolant from said inlet to rotate in said pulsation chamber and deliver said flushing coolant in pulsed bursts to said outlet, said inlet having an acceleration ramp directing and accelerating flushing coolant along a direction having an arcuate component and impinging said vanes.

* * * * *